US006138308A

United States Patent [19]

Düsterwald et al.

[11] Patent Number: 6,138,308

[45] Date of Patent: Oct. 31, 2000

[54] PROCESS AND SYSTEM FOR DYEING A TEXTILE WEB USING THE COLD-PAD BATCH PROCESS

[75] Inventors: Günther Düsterwald; Rosemarie Schröder, both of Krefeld, Germany

[73] Assignee: Eduard Kusters Maschinenfabrik GmbH & Co. KG, Krefeld, Germany

[21] Appl. No.: 09/249,981

[22] Filed: Feb. 12, 1999

[30] Foreign Application Priority Data

Feb. 13, 1998 [DE] Germany ..... 198 05 840

[51] Int. Cl.[7] ..... D06B 3/10

[52] U.S. Cl. ..... 8/151; 8/154; 68/13 R; 68/189

[58] Field of Search ..... 8/149.1, 150, 154, 8/155.2, 151; 68/5 C, 13 R, 198

[56] References Cited

U.S. PATENT DOCUMENTS 4,163,298 8/1979 Schuierer ..... 68/13 R X

FOREIGN PATENT DOCUMENTS 44 08 416 12/1995 Germany .

709605 5/1954 United Kingdom ..... 8/155.2

*Primary Examiner*—Philip R. Coe

*Attorney, Agent, or Firm*—Kenyon & Kenyon

[57] ABSTRACT

A process and a system for dyeing a textile web according to the cold-pad batch process includes a device for defined application of a dye liquor to the textile web and a winding device for rolling the textile web provided with the dye liquor onto a fabric roll. On the winding device, a supply roll with a plastic film web is mounted, which can be wound around the finished fabric roll in a wrap, using the same winding device. The end of the wrap is sealed together with the plastic film web and the plastic film web is cut off. In this way, it is easier to wrap the fabric roll, as is necessary for several hours of dwell time on the fabric roll.

10 Claims, 1 Drawing Sheet

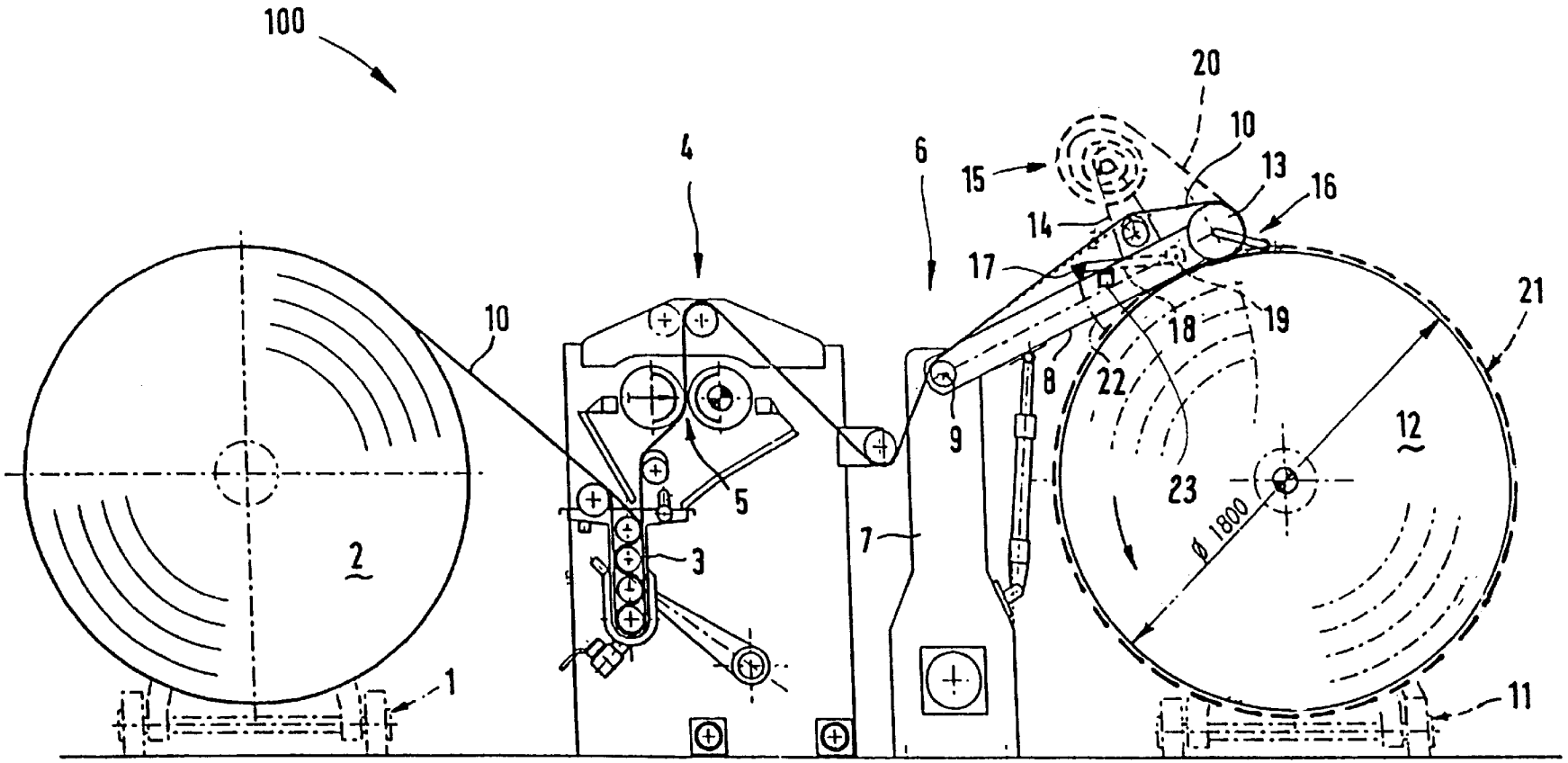
100
1
2
3
4
5
6
7
8
9
10
11
12
13
14
15
16
17
18
19
20
21
22
23
Ø 1800

PROCESS AND SYSTEM FOR DYEING A TEXTILE WEB USING THE COLD-PAD BATCH PROCESS

BACKGROUND OF THE INVENTION

The invention relates to a process for dying a textile web via the cold-pad batch process, in which the textile web is provided with a defined application amount of treatment liquor, is rolled onto a fabric roll in the damp state, and allowed to remain in an air-tight, wrapped-up state. The invention further relates to a system for implementing this process, in which a device for defined application of a dye liquor to the textile web and a winding device for winding the textile web is provided.

A process of this type and such a system are known from DE 44 08 416 C2, which shows a wet treatment system with subsequent rinsing basin, from which the textile web is wound onto a fabric roll, in its exemplary embodiment. If the wet treatment is a dyeing process according to the cold-pad batch process (CPB process), the padded fabric on the fabric roll must be wrapped in plastic film, so that it does not dry out during the dwell time of about 10 hours.

Until the present time, wrapping the fabric roll in plastic film has been done by hand. Because of the size of the fabric roll, which can have a diameter of up to 2 m and a length of up to 3 m, this is a complicated and time-consuming process.

SUMMARY OF THE INVENTION

The present invention is directed to the task of improving the procedure for wrapping the fabric roll in a plastic film.

The present invention teaches a process for dyeing a textile web via a cold-pad batch process, in which a textile web is first treated with a defined amount of treatment liquor. The treated web is then wound into a fabric roll in the damp state with a winding device. At least one wrap (a length of film sufficiently long to be wrapped completely about the fabric roll) of a plastic film web is pulled off a supply roll and then wound onto the fabric roll using the winding device. The plastic film is severed from its roll and the wrap is tightly connected (including its leading edge) to the fabric roll. The fabric roll is kept in an air-tight, wrapped-up state for a period of time as called for.

To recapitulate, a key idea is to wrap the plastic film web around the fabric roll, in the same winding direction, after the fabric roll has been completed, and after at least one wrap of the plastic film has been formed, to tightly connect the leading edge of the wrap with the part of the film web that has been wound around the fabric roll. The film web is then cut off. In doing this, the difficult part of wrapping the fabric roll, namely forming the first wrap, is accomplished using the existing winding device. The film web is slightly wider than the textile web and is turned in at the edges of the faces, and tightly connected by covering the faces of the fabric roll with adhesive strips. This process can still be performed by hand, since it is easier to do than forming the wrap. Only one wrap or two or more wraps of plastic film web 20 can be wound on before they are connected, i.e. the plastic film web can have one or more layers at the connection point.

In the preferred exemplary embodiment of the invention, connecting the leading edge of the wrap with the film web that forms the wrap is done by sealing it.

The invention also presents an apparatus for practicing the method, namely a foulard for application of a defined quantity of dye liquor to a textile web; a winding device for winding the textile web into a fabric roll; and a supply roll of plastic film web mounted on the winding device so that a wrap of the plastic film web can be wound around the finished fabric roll using the winding device. Further apparatus is provided to tightly connect the free ends of the plastic film web to the wrap so as to provide a wrap that is tightly wound circumferentially about the fabric roll.

Means for cutting the film web off outside of the connection point can be provided, but cutting it off by hand is not excluded.

Sealing of the plastic film web can take place using a sealing crosspiece, which can be arranged on pivoting arms, so that after a fabric roll has been completed, it can be pivoted against the surface of the wrap of plastic film web that has been formed by the winding device.

The cutting device can also be arranged on the pivoting arms of the sealing crosspiece.

BRIEF DESCRIPTION OF THE DRAWING

The drawing shows an exemplary embodiment of the invention, in schematic form, viewed from the side.

DETAILED DESCRIPTION

The system, designated as a whole as 100, serves for cold-pad batch dyeing of a textile web 10, which is unwound from a large fabric roll 2 mounted on a fabric roll carriage 1. Textile web 10 runs from fabric roll 2 into trough 3 of a foulard, designated as a whole as 4, and is uniformly squeezed to a predetermined residual moisture in squeezing unit 5 of foulard 4, after it has left trough 3.

With this residual moisture, textile web 10 is wound onto a fabric roll 12, in a winding device designated as a whole as 6, which is mounted at the other end of system 100, on a fabric roll carriage 11. winding device 6 possesses a machine stand 7, at the upper end of which, laterally outside of textile web 10, two winding arms 8 which can pivot up and down around an axis 9 are mounted to pivot. A press-down roller 13 is mounted at the free end of winding arms 8, which extends crosswise across the width of textile web 10 and is pressed radially from the outside against fabric roll 12, in order to guarantee that it forms uniformly as it is wound.

In the vicinity of press-down roller 13, a supply roll 15, indicated with broken lines in the drawing, is mounted to rotate on bearing blocks 14 which project upward from winding arms 8, and a plastic film web 20, impermeable to air and water, indicated with broken lines, is wound up on it, and is slightly wider than textile web 10.

As long as textile web 10 is being wound up on fabric roll 12, plastic film web 20 remains on supply roll 15. When fabric roll 12 has been finished, plastic film web 20 is pulled from supply roll 15 and introduced into winding nip 16 between press-down roller 13 and fabric roll 12. Then fabric roll 12 is made to rotate again, and at least one wrap 21 of plastic film web 20 is formed on the circumference of the fabric roll, so that fabric roll 12 is entirely surrounded by plastic film web 20 in the circumference direction, and the leading edge of plastic film web 20 and the subsequent region of the same overlap. This situation is shown in the drawing. Fabric roll 12 is then made to stop, and a sealing crosspiece 17 which extends crosswise across plastic film web 20 is pivoted against the circumference of fabric roll 12. Sealing crosspiece 17 is arranged at the ends of two pivoting arms 18, which are mounted to pivot around a pivoting axis 19 at their other ends, in the vicinity of press-down roller 13, on winding arms 8. Sealing crosspiece 17 therefore moves in an arc 22 against the outside circumference of wrap 21, and seals the regions of wrap 21 of plastic film web 20 which lie on top of one another together, to be air-tight and water-tight.

A cutting device, 23, is integrated into sealing crosspiece 17, and the end of plastic film web 20 which follows can be cut off with this device.

After plastic film web 20 has been cut off, the free end is wound back onto supply roll 15, and winding of the next fabric roll 12 takes place.

The ends of plastic film web 20 which project beyond the faces of fabric roll 12 are brought down to cover the faces of fabric roll 12 and glued down, using adhesive tape and a cover disk for the faces.

What is claimed is:

1. A process for dyeing a textile web via a cold-pad batch process, comprising the steps of:

treating a textile web with a defined amount of treatment liquor;

winding the treated textile into a fabric roll in the damp state with a winding device; and winding at least one wrap of a plastic film web onto the fabric roll using the winding device;

tightly connecting the leading edge of the plastic film web to the wrap; and severing the wrap from the plastic film web;

wherein the fabric roll is kept in an air-tight, wrapped-up state for a period of time.

2. A process as set forth in claim 1, wherein the leading edge of the wrap is sealed to the film web.

3. A system for treating a textile web with liquor via a cold-pad batch process, comprising;

a foulard for application of a defined quantity of dye liquor to a textile web;

a winding device for winding the textile web imbued with the dye liquor onto a fabric roll;

a supply roll of plastic film web mounted on the winding device so that a wrap of the plastic film web can be wound around the finished fabric roll using the winding device; and means for tightly connecting ends of the plastic film web to the wrap so as to provide a wrap that is tightly circumferentially wound about the fabric roll.

4. The system according as set forth in claim 3, further comprising means on the winding device for severing the plastic film web at a location apart from where it wraps about the fabric roll.

5. A system as set forth in claim 4, wherein the means for connecting the leading edges of the wrap of the plastic film web with the wrap comprises a sealing crosspiece which reaches crosswise across the plastic film web, wherein the crosspiece can be displaced to touch the wrap.

6. A system as set forth in claim 3, wherein the winding device comprises:

winding arms arranged laterally outside of the textile web, which can be pivoted around a horizontal axis at one end of the arms;

a press-down roller located between the winding arms, said press-down roller being mounted at another end of the arms, and which rests against the fabric roll forming a winding nip, by way of which roller the textile web can be passed onto the fabric roll; and a supply roll of plastic film in the vicinity of the press-down roller from which the plastic film web is drawn, said supply roll being mounted on the winding arms, and from which the plastic film web can be passed around the fabric roll in a wrap, through the winding nip, after the fabric roll has been formed.

7. A system as set forth in claim 6, wherein the means for connecting the leading edges of the wrap of the plastic film web with the wrap comprises a sealing crosspiece which reaches crosswise across the plastic film web, wherein the crosspiece can be displaced to touch the wrap.

8. system as set forth in claim 3, wherein the means for connecting the leading edges of the wrap of the plastic film web with the wrap comprises a sealing crosspiece which reaches crosswise across the plastic film web, wherein the crosspiece can be displaced to touch the wrap.

9. The system according to claims 8, wherein the sealing crosspiece is arranged at the ends of pivoting arms which are mounted to pivot on the winding arms at their opposite ends.

10. The system according to claim 9, further comprising a cutting device arranged at the pivoting arms, which can be used to cut the plastic film web at a location apart from where it wraps about the fabric roll.

* * * * *